United States Patent [19]

Ashton

[11] 3,996,636

[45] Dec. 14, 1976

[54] FLOOR SCRUBBING MACHINE

[75] Inventor: Walter G. Ashton, Winnetka, Ill.

[73] Assignee: Star Industries, Inc., Highland Park, Ill.

[22] Filed: Dec. 17, 1975

[21] Appl. No.: 641,499

[52] U.S. Cl. ..... 15/50 R; 15/87; 280/97

[51] Int. Cl.[2] ..... A47L 11/283; A44L 11/293

[58] Field of Search ..... 15/49 R, 49 C, 50 R, 15/50 C, 79 A, 82–87, 340; 280/87 M, 97

[56] References Cited

UNITED STATES PATENTS

| | | | |
|---|---|---|---|
| 2,918,302 | 12/1959 | Hartenstine | 280/97 |
| 3,006,021 | 10/1961 | Patch | 15/83 |
| 3,823,791 | 7/1974 | Sheler | 15/50 R |

*Primary Examiner*—Edward L. Roberts
*Attorney, Agent, or Firm*—Edward C. Threedy

[57] ABSTRACT

An operator-driven, hydraulic, front-wheel, traction-drive floor scrubbing and sweeping machine having a steerable undercarriage supporting the front wheels as well as the retractable scrubber-squeegee assembly.

8 Claims, 7 Drawing Figures

80
79
78
77
22
76

29
30
58
50
25
23
74
19
28
27
33
32
20
34
21
49
24
73
51
36
71
70
72
59'
68
31
64
61'
66
61
62

81
83
84
22
82
87
20
88
86
85

77
50
74
30
58
75

FLOOR SCRUBBING MACHINE

SUMMARY OF THE INVENTION

This invention relates to a floor scrubbing machine for cleaning and maintaining large areas of floor space. More particularly this invention relates to an improved form of such floor scrubbing machine whereby the driving and steering wheels as well as the scrub brushes, squeegees and sweeper assembly are carried by an undercarriage having an improved form of connection to the vehicle frame, whereby the latter may be readily maneuvered and operated by the operator.

Particularly, this invention relates to a power-driven riding type operator-controlled mobile vehicle having a front-wheeled undercarriage supporting the retractable scrubbing and squeegee assembly as well as the floor sweeper and its receptacle. The retractable scrubber comprises a plurality of hydraulically operated circular scrubbing brushes having associated therewith a squeegee assembly, all of these components being connected to the undercarriage by horizontally spaced pivotal links pivotally connected to the undercarriage as well as the scrubber-squeegee assembly. A hydraulic lifting means is employed for effecting a parallel movement between the links to raise or lower the scrubber-squeegee assembly relative to the undercarriage.

GENERAL DESCRIPTION

The structure and objects of the invention will be best understood by reference to the accompanying drawings showing a preferred form of construction, and in which.

Figure 1:
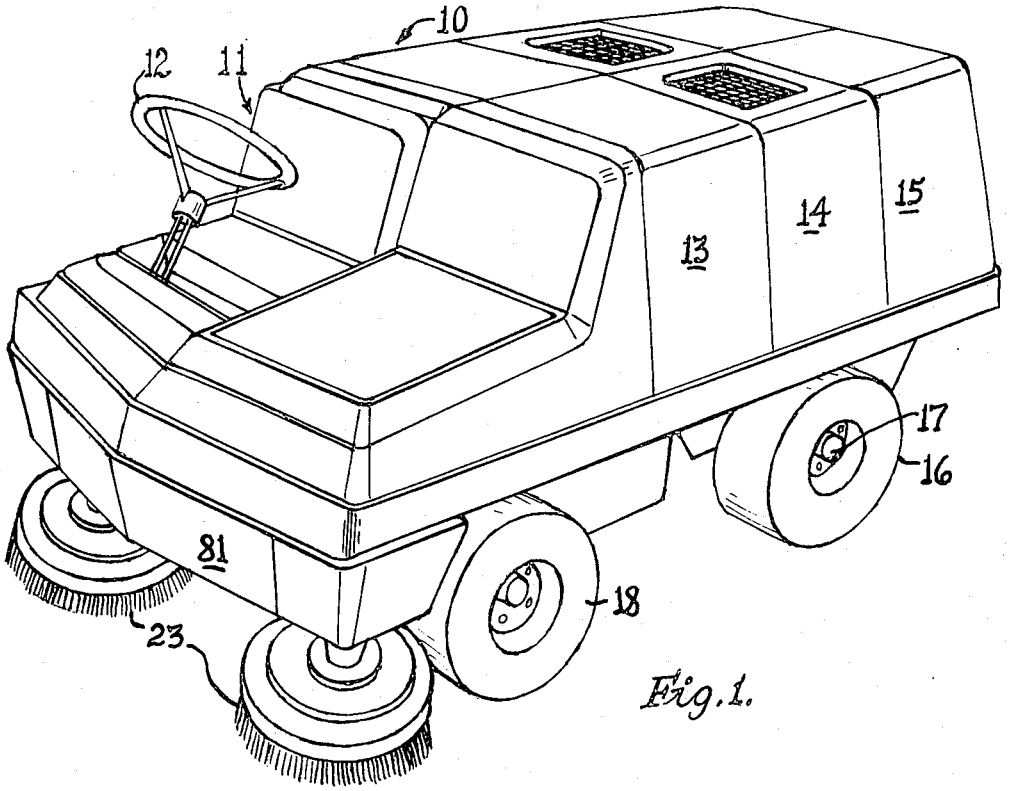
FIG. 1 is a perspective view of the floor scrubbing machine.

As shown in FIG. 1, the floor scrubbing machine of this invention is illustrated as a self-propelled vehicle 10 providing a driver compartment 11 provided with a suitable steering wheel 12 and other controls (not shown). The vehicle includes a solution tank 13, a motor compartment 14 and a recovery tank 15, all supported upon the frame of the vehicle 10 to the rear of the driver compartment 11 and immediately above the rear wheels 16, which are in turn rotatably mounted on a fixed shaft 17.

The front wheels 18 of the vehicle are mounted on an undercarriage 19 (see FIG. 3), which, through a kingpin 20 projecting through a suitable bearing 21, is connected to a portion of the frame 22 of the vehicle 10.

Figure 4:
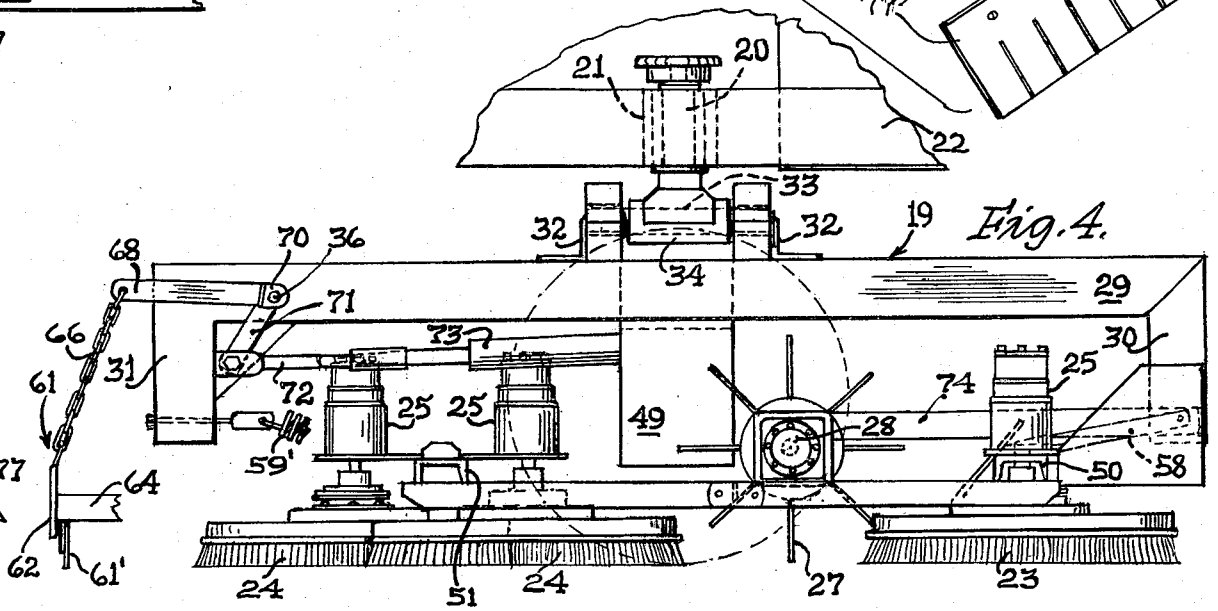
FIG. 4 is an opposite side fragmentary view of the undercarriage and the components of this invention.

As shown in FIG. 4, the undercarriage 19 is adapted to support a pair of front rotatable scrubbing brushes 23 as well as a pair of staggered rear scrubbing brushes 24. These scrubbing brushes are adapted to be rotated by suitable hydraulic motors 25 of a construction well known in the art and which make up no part of the present invention. The undercarriage likewise supports the front wheels 18, which are in turn driven by suitable hydraulic motors 26, as shown in FIG. 2.

Between the front scrubbing brushes 23 and carried beneath the undercarriage 19 between the front wheels 18, is a sweeping broom 27 which likewise by a hydraulic motor 28 is self-operated.

Figure 2:
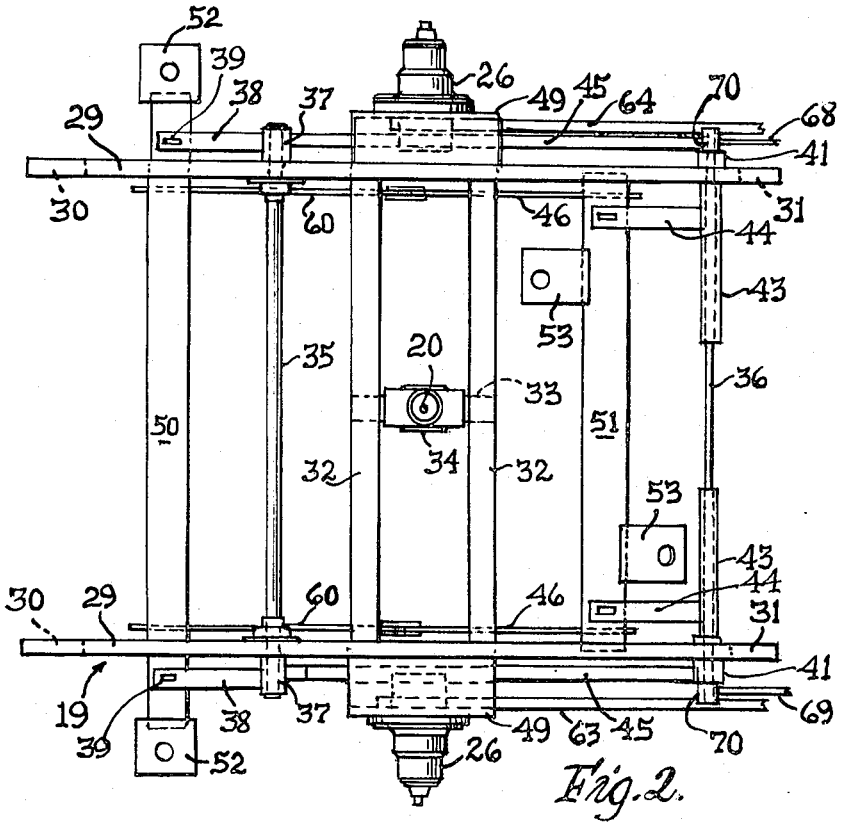
FIG. 2 is a top plan view of certain structural components of the undercarriage.
Figure 3:
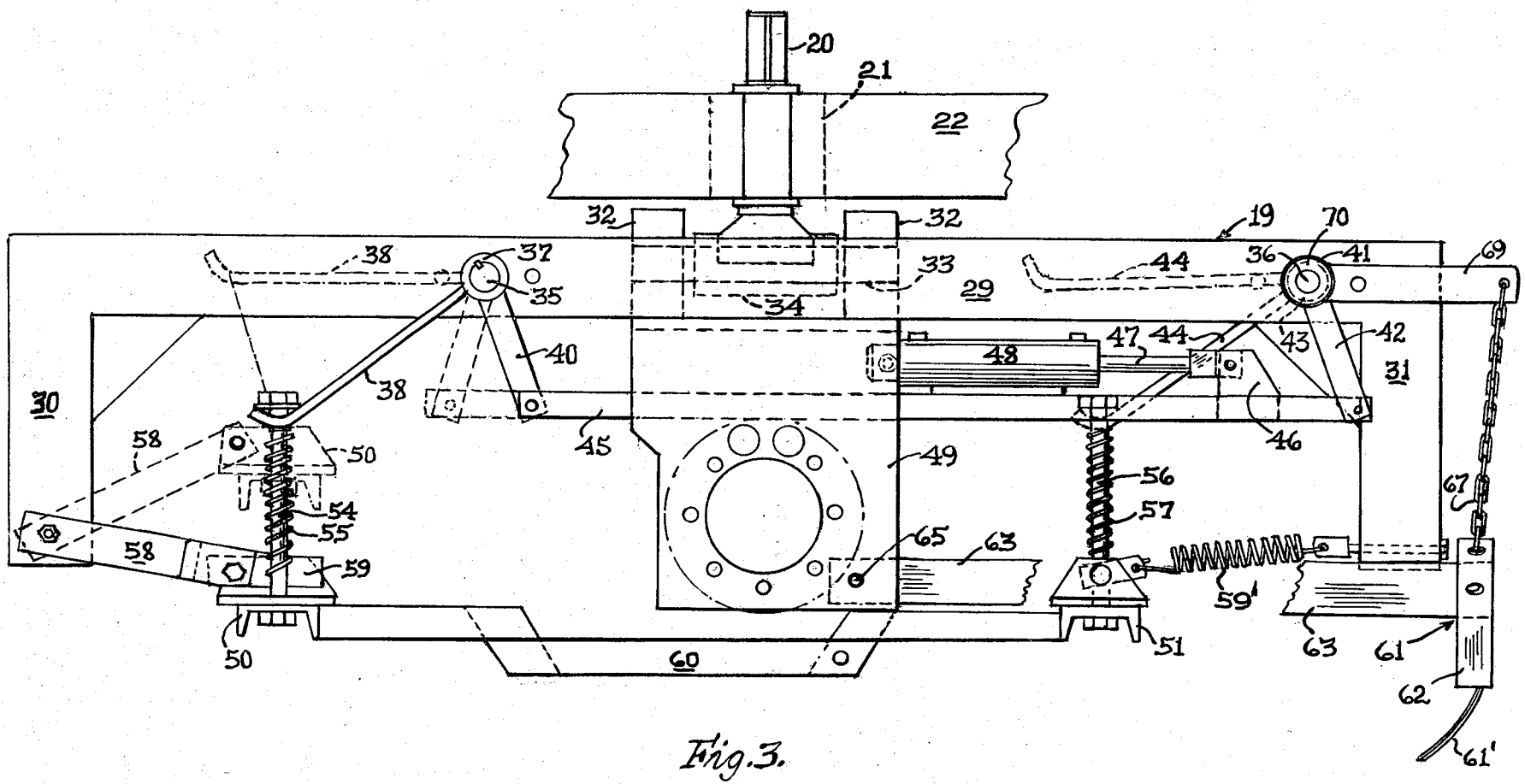
FIG. 3 is a fragmentary side elevational view of certain components of the undercarriage.

As shown in FIGS. 2 and 3, the undercarriage 19 comprises a pair of horizontal beams 29, the opposite ends of which terminate into depending legs 30 and 31. Extending between the horizontal beams 29 of the undercarriage 19 are a pair of cross supports 32 which, intermediate their ends, have journalled therebetween a rod 33 which is journalled through and supports a bearing 34 carried by the lowermost free end of the kingpin 20. By this arrangement the undercarriage 19 is attached beneath the frame 22 for movement pivotally with respect thereto.

Also extending between the beams 29 is a forward shaft 35 and a rear shaft 36. As seen in FIG. 2, both shafts 35 and 36 extend beyond the side planes of the horizontal beams 29. To the exposed ends of the shaft 35 there is mounted a circular bushing 37 which has an arm 38 extending radially therefrom. The free end of the arm 38 is bent out of its normal plane as shown in FIG. 3 and is slotted as at 39. Also extending radially from the bushing 37 but angularly with respect to the arm 38, is a link arm 40.

Mounted on the rear shaft 36 outwardly of the beams 29 are bushings 41 which in turn provide a radially extending link arm 42. The bushings 41 include sleeves 43 which are disposed between the beams 29 and which in turn provide radially extending arms 44. The arrangement is such that through the bushings 41 and sleeves 43 the link arm 42 and arms 44 will be adapted to be moved together independently of the shaft 36. The arms 44 are of a like construction and configuration as the arms 38 heretofore described.

A pair of bars 45 are adapted to extend between the respective link arms 40 and 42 and be pivotally connected to the free ends thereof. To one of the bars 45 by a bracket 46 there is connected the free end of a hydraulic piston 47 operatively associated with a piston cylinder 48, which in turn is supported by a wheel plate 49 extending outwardly and downwardly from each of the horizontal beams 29, as shown in FIG. 2.

The front scrubbing brushes 23 are carried at opposite ends of a brush support 50 so as to be positioned substantially outwardly of the beams 29 of the undercarriage 19, as seen in FIG. 2. The rear scrubbing brushes 24 are carried by a support 51 and are positioned so as to be substantially inward of the horizontal beams 29 of the undercarriage 19, as seen in FIG. 2. The respective hydraulic motors 25 for the scrubbing brushes 23 and 24 are carried by suitable support plates 52 and 53 carried by the respective supports 50 and 51.

Extending upwardly from the support 50 inwardly of the ends thereof are pins 54. These pins 54 are adapted to project through the slot 39 formed in the curved free end of the arms 38. An expansion spring 55 is coiled about the pin 54 and extends between the support 50 and the slotted end of the arm 38. A like set of pins 56 and coil springs 57 are arranged between the support 51 and the arms 44 supported by the rear shaft 36.

A guide arm 58 has one end pivotally connected to the lowermost free end of the front leg 30 and to a connecting bracket 59 mounted on the support 50, as shown in FIG. 3. A horizontally extending spacer bar 60 extends between the supports 50 and 51 so as to maintain the spacing therebetween during relative movement in a manner hereinafter described.

As viewed in FIG. 3, when the hydraulic cylinder 48 is actuated, it will draw in its piston 47, which in turn, through its connection to one of the bars 45, will cause the same to shift forwardly in a horizontal direction. This movement will be imparted to the link arms 40 and 42, causing rotation of the bushings 37 and 41 as well as the sleeves 43, about their respective shafts 35 and 36. The rotation of the bushings 37 and 41 will cause a lifting action on the arms 38 and 44, which in turn, through the pins 54 and 56, will raise the scrubbing brush supports 50 and 51, which in turn will raise the scrubbing brushes 23 and 24 off the floor surface.

The movement of the brushes 23 and 24 will be substantially through a vertical component by reason of the pivotal arm 58 connected between the front support 50 and the front leg 30 of the undercarriage 19. To assist this substantially vertical movement, a coil spring 59′ is connected between the rear support 51 and the rear leg 31 of the undercarriage 19, as shown in FIG. 3.

A squeegee assembly 61 is adapted to be carried by the undercarriage 19 and consists of a rubber squeegee blade 61′ mounted on a plate 62, which has its opposite ends connected to a pair of support braces 63 and 64 which in turn have their opposite free ends pivotally connected as at 65 to the depending wheel plates 49. The supporting plate 62 of the squeegee assembly 61 is at each end connected by a chain 66 and 67 to one end of corresponding link arms 68 and 69. These link arms 68 and 69 are in turn mounted on bushings 70 fixedly connected to the exposed ends of the rear shaft 36. One of the bushings 70, as seen in FIG. 4, is provided with a depending arm 71, which in turn is connected to one end of a piston 72 of a hydraulic piston cylinder 73.

As seen in FIG. 4, the squeegee assembly 61 is in its operative position, and when the cylinder 73 is actuated to further expel its piston 72, the squeegee assembly 61, through the arms 71, 68–69, will be caused to pivot in a clockwise direction, raising the squeegee assembly 61 relative to the floor surface.

Figure 6:
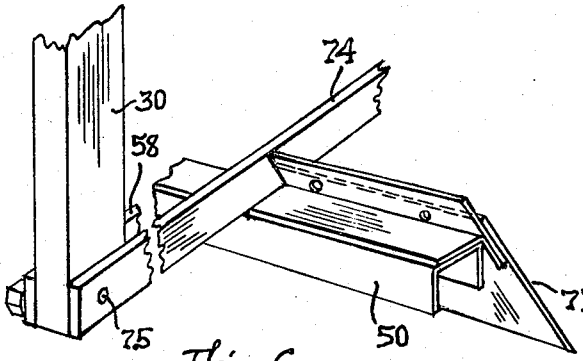
FIG. 6 is a fragmentary view of the method of connecting a sweeper deflector plate to the undercarriage.

As indicated earlier, the machine also includes in addition to the floor scrubbing brushes and squeegee assembly, a sweeper broom 27. As shown in FIGS. 4 and 6, the sweeper broom 27 is carried by the free ends of a pair of supporting bars 74 (one of which is shown in FIGS. 4 and 6). The supporting bar 74 is pivotally connected as at 75 to the inside of the front depending legs 30. In their normal operative position they will extend above and to the rear of the support 50 and independently support the sweeper broom 27 as well as its hydraulic motor 28. As viewed in FIG. 4, the sweeper broom 27 is designed to have a counterclockwise rotation such that articles on the floor will be swept upwardly into a suitable receptacle 76 (see FIG. 7).

To accomplish this purpose, there is mounted on the support 50 a deflector plate 77. This deflector plate 77 will match with the front edge 78 of the receptacle 76 so as to receive all debris swept therein by the broom 27.

Figure 7:
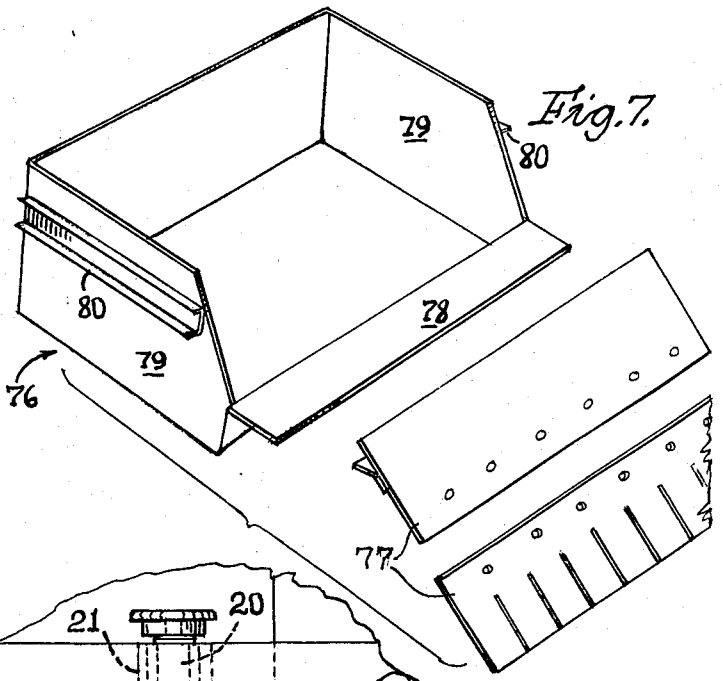
FIG. 7 is a perspective view of the sweeper receptacle and certain parts thereof in exploded relation.

As shown in FIG. 7, the side walls 79 of the receptacle are each provided with a U-shaped track 80 which is adapted to be slid upon the supporting bar 74 so as to mount the same between the front scrubbing brushes 23. The receptacle 76 is removable through the front bumper 81 of the vehicle 10, as seen in FIG. 1.

By this arrangement, when the front scrubbing brushes 23 are raised through the assembly heretofore described, the support 50 will engage the undersurface of the support bars 74 and likewise pivot them in a substantially vertical direction so as to raise the receptacle 76 when the scrubbing brushes 23 are not in an operative position.

As heretofore indicated, the undercarriage 19 supports the driving and steering wheels 18 through the kingpin 20 which is universally journalled with respect to the frame 22 of the vehicle 10.

Figure 5:
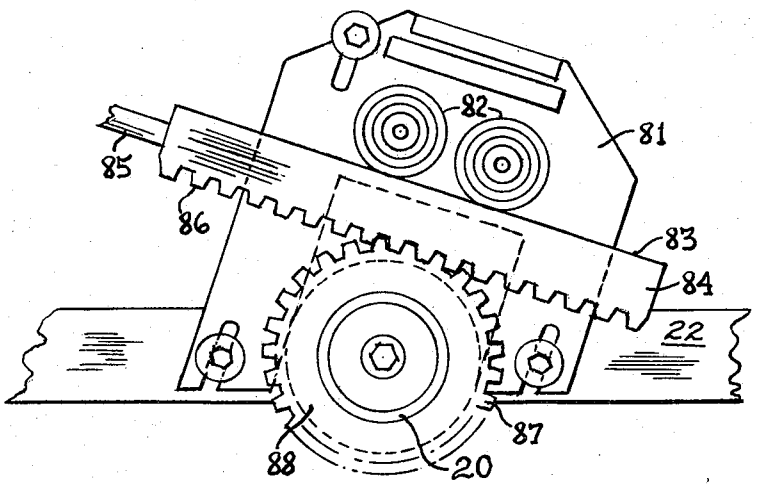
FIG. 5 is a fragmentary top plan view of the steering mechanism employed in this invention.

To steer the undercarriage 19, there is provided a mechanism illustrated in FIG. 5. As shown, there is mounted on the frame 22 a plate 81, which supports a pair of guide rollers 82 which engage the flat rear surface 83 of a rack 84. The rack 84 by a piston 85 is connected to a hydraulic cylinder so that it may move reciprocally in a manner to have its rack teeth 86 engaged with the teeth 87 of a pinion gear 88 fixedly attached to the kingpin 20. The actuation of the piston 85 to move longitudinally in a reciprocal manner the rack 84, is through the steering wheel 12 situated in the driver compartment 11 of the vehicle 10. From the foregoing, it is apparent that I have provided for a driving and steering arrangement of an undercarriage to a vehicle, which in turn supports a scrubbing, squeegee, and sweeping assembly as well as the driving and steering wheels for the vehicle. By the specific arrangement of components, the scrubber, squeegee, and sweeper assembly is adapted to be elevated with respect to the surface to be cleaned, irrespective of the steering and driving wheels of the undercarriage. By this arrangment, the machine has a high degree of versatility, in that the scrubbing brushes may be made accessible to extremely tight corners and surfaces of varying elevations.

While I have illustrated and described the preferred form of construction for carrying my invention into effect, this is capable of variation and modification without departing from the spirit of the invention. I, therefore, do not wish to be limited to the precise details of construction set forth, but desire to avail myself of such variations and modifications as come within the scope of the appended claims.

Having thus described my invention, what I claim as new and desire to protect by Letters Patent is:

1. In a floor scrubbing machine including a self-propelled vehicle providing a driver compartment, solution tanks, a motor compartment and a recovery tank, wherein the improvement comprises a. a main frame for the machine having a pair of rear wheels rotatably mounted on a fixed shaft beneath the motor compartment of the vehicle, b. an undercarriage mounted beneath a portion of said main frame, c. means connecting said undercarriage to said main frame of the vehicle for pivotal movement relative thereto, d. driving wheels for said vehicle carried by said undercarriage for steering and propelling the vehicle as directed by the driver thereof, e. means under the control of the driver for turning said undercarriage through a horizontal plane relative to the vehicle, f. a plurality of scrubbing brush and squeegee assemblies carried by the undercarriage and adapted for movement independently of the vehicle, g. means for moving said scrubbing brush and squeegee assemblies through a substantially vertical component relative to said undercarriage, and h. a sweeping broom carried by said undercarriage and movable with said scrubbing brush and squeegee assemblies through a substantially vertical component relative to said undercarriage.

2. In a floor scrubbing machine as defined by claim 1, wherein said means connecting said undercarriage to said main frame comprises a kingpin carried by a bearing freely supported by a transversely extending rod connected to said undercarriage for movement about a horizontal axis, with said kingpin freely journalled through a bearing provided by said main frame for rotation about a vertical axis.

3. In a floor scrubbing machine as defined by claim 1, wherein said means under the control of the driver for turning said undercarriage comprises a rack and pinion gear assembly connected to and operable upon said means connecting said undercarriage to said main frame, for steering the machine.

4. In a floor scrubbing machine as defined by claim 1, wherein said means for moving said scrubbing brush and squeegee assemblies comprises a parallelogram-bar arrangement pivotally connected to said undercarriage for supporting said assemblies and having hydraulic means for lifting said parallelogram-bar arrangement so as to raise said assemblies substantially through a vertical component.

5. In a floor scrubbing machine as defined by claim 2, wherein said means under the control of the driver for turning said undercarriage comprises a rack and pinion gear assembly connected to and operable upon said kingpin, for steering the machine.

6. In a floor scrubbing machine as defined by claim 2, wherein said means for moving said scrubbing brush and squeegee asemblies comprises a parallelogram-bar arrangement pivotally connected to said undercarriage for supporting said assemblies and having hydraulic means for lifting said parallelogram-bar arrangement so as to raise said assemblies substantially through a vertical component.

7. In a floor scrubbing machine as defined by claim 4, wherein said means under the control of the driver for turning said undercarriage comprises a rack and pinion gear assembly connected to and operable upon said means connecting said undercarriage to said main frame, for steering the machine.

8. In a floor scrubbing machine as defined by claim 5, wherein said means for moving said scrubbing brush and squeegee assemblies comprises a parallelogram-bar arrangement pivotally connected to said undercarriage for supporting said assemblies and having hydraulic means for lifting said parallelogram-bar arrangement so as to raise said assemblies substantially through a vertical component.

* * * * *